US006854205B2

(12) United States Patent
Wikle et al.

(10) Patent No.: US 6,854,205 B2
(45) Date of Patent: Feb. 15, 2005

(54) GRIP AND FIREARM WITH GRIP HAVING INTERNAL INWARDLY STEPPED BATTERY STORAGE CHAMBER

(76) Inventors: Timothy Carver Wikle, 1021 Roanoke Rd., San Marino, CA (US) 91108; Timothy John Bowman, 1132 Beaumont Dr., San Jose, CA (US) 95129; Jeffrey Matthew Cahill, 6 Fulmar La., Aliso Viejo, CA (US) 92656

( * ) Notice: Subject to any disclaimer, the term of this patent is extended or adjusted under 35 U.S.C. 154(b) by 0 days.

(21) Appl. No.: 10/731,216

(22) Filed: Dec. 9, 2003

(65) Prior Publication Data

US 2004/0111946 A1 Jun. 17, 2004

Related U.S. Application Data

(60) Provisional application No. 60/431,828, filed on Dec. 9, 2002.

(51) Int. Cl.[7] ..... F41C 23/22

(52) U.S. Cl. ..... 42/71.02; 42/7; 42/71.01

(58) Field of Search ..... 42/7, 71.01, 71.02, 42/88, 95, 96, 106; 89/195; 16/110.1, 111.1; 206/499, 524.1; 222/79, 192; 362/109, 110; 429/99, 176

(56) References Cited

U.S. PATENT DOCUMENTS

| | | | | | |
|---|---|---|---|---|---|
| 1,266,024 | A | * | 5/1918 | Kennedy | 42/71.01 |
| 2,298,678 | A | * | 10/1942 | Chase | 42/71.01 |
| 3,941,618 | A | | 3/1976 | Mabuchi | 429/99 |
| 4,022,350 | A | | 5/1977 | Amron | 229/79 |
| 4,205,121 | A | | 5/1980 | Naitoh | 429/89 |
| 4,206,274 | A | | 6/1980 | Peels | 429/89 |
| 4,276,807 | A | * | 7/1981 | Whitlock | 89/37.04 |
| 4,457,091 | A | * | 7/1984 | Wallerstein | 42/70.11 |
| 4,488,370 | A | * | 12/1984 | Lemelson | 42/70.01 |
| 4,512,101 | A | * | 4/1985 | Waterman, Jr. | 42/71.01 |
| 4,563,827 | A | * | 1/1986 | Heltzel | 42/70.01 |
| 4,576,880 | A | | 3/1986 | Verdier et al. | 429/99 |
| 4,682,435 | A | * | 7/1987 | Heltzel | 42/70.01 |
| 4,737,420 | A | | 4/1988 | Ikeda et al. | 429/1 |
| 4,750,641 | A | | 6/1988 | Chin-Fu | 222/79 |
| 4,970,819 | A | * | 11/1990 | Mayhak | 42/70.01 |
| 4,996,787 | A | * | 3/1991 | Holcomb et al. | 42/7 |
| 5,001,772 | A | | 3/1991 | Holcomb et al. | 455/575.1 |
| 5,052,138 | A | * | 10/1991 | Crain | 42/1.02 |
| 5,159,136 | A | * | 10/1992 | Marsh | 42/71.01 |
| 5,303,495 | A | * | 4/1994 | Harthcock | 42/84 |
| 5,423,143 | A | * | 6/1995 | Martin | 42/70.01 |
| 5,448,847 | A | * | 9/1995 | Teetzel | 42/70.11 |
| 5,469,790 | A | * | 11/1995 | Singer | 102/431 |
| 5,502,915 | A | * | 4/1996 | Mendelsohn et al. | 42/70.11 |
| 5,549,220 | A | | 8/1996 | Whalen | 222/1 |
| 5,557,872 | A | * | 9/1996 | Langner | 42/117 |
| 5,598,082 | A | | 1/1997 | Gilpin et al. | 200/293 |
| 5,735,070 | A | * | 4/1998 | Vasquez et al. | 42/1.02 |
| 5,799,433 | A | * | 9/1998 | Danner et al. | 42/1.05 |
| 5,813,157 | A | * | 9/1998 | Scott et al. | 42/71.01 |
| 5,842,300 | A | * | 12/1998 | Cheshelski et al. | 42/116 |
| 5,937,557 | A | * | 8/1999 | Bowker et al. | 42/70.01 |
| 6,173,519 | B1 | * | 1/2001 | Garrett | 42/90 |
| 6,321,478 | B1 | * | 11/2001 | Klebes | 42/84 |
| 6,343,429 | B1 | * | 2/2002 | Mossberg et al. | 42/70.01 |
| 6,357,157 | B1 | * | 3/2002 | Constant et al. | 42/84 |
| 6,370,806 | B1 | * | 4/2002 | Klebes et al. | 42/84 |
| 6,442,880 | B1 | * | 9/2002 | Allan | 42/70.08 |
| 6,449,892 | B1 | * | 9/2002 | Jenkins | 42/1.01 |
| 6,536,152 | B1 | | 3/2003 | Wisz | 42/71.01 |
| 6,543,172 | B1 | * | 4/2003 | Armstrong | 42/71.01 |
| 6,631,579 | B1 | * | 10/2003 | Lauster et al. | 42/70.11 |
| 6,754,935 | B2 | * | 6/2004 | Pozgay et al. | 16/422 |

* cited by examiner

*Primary Examiner*—Michael J. Carone
*Assistant Examiner*—John Richardson
(74) *Attorney, Agent, or Firm*—Christie, Parker and Hale, LLP

(57) ABSTRACT

A grip for attachment to a firearm is provided. The grip includes an internal battery storage chamber having at least one inwardly stepped storage cavity that includes a plurality of battery compartments for storing a plurality of batteries.

24 Claims, 6 Drawing Sheets

GRIP AND FIREARM WITH GRIP HAVING INTERNAL INWARDLY STEPPED BATTERY STORAGE CHAMBER

CROSS-REFERENCE TO RELATED APPLICATION(S)

This application claims priority under 35 U.S.C. § 119(e) to U.S. Provisional Application Ser. No. 60/431,828, filed on Dec. 9, 2002, which is incorporated herein by reference.

FIELD OF THE INVENTION

This invention relates to a grip, and more particularly, to a grip and/or a firearm with a grip having an internal battery storage chamber.

BACKGROUND OF THE INVENTION

Modern firearms often require batteries for the operation of various firearm features, such as laser sight lines, lights, laser illuminators, laser target designators, infra-red lights, illuminated sights, and holographic sights. Accordingly, a need exists for a firearm grip having an internal battery storage chamber and/or a firearm grip having a hinged pull tab that removably covers a firearm grip cavity.

SUMMARY OF THE INVENTION

In one embodiment, the present invention is a grip for attachment to a firearm. The grip includes an internal battery storage chamber having at least one inwardly stepped storage cavity that includes a plurality of battery compartments for storing a plurality of batteries.

In another embodiment, the present invention is a firearm grip for attachment to a firearm that includes an internal battery storage chamber having at least one inwardly stepped storage cavity that includes a plurality of battery compartments adjacently positioned longitudinally in series for storing a plurality of batteries, wherein each successive battery compartment in the series is smaller than its adjacent battery compartment when viewed from a lower portion of the firearm grip to an upper portion of the firearm grip and wherein each battery compartment shares a common wall that is substantially smooth and extends substantially across the length of the storage cavity.

In yet another embodiment, the present invention is a firearm grip for attachment to a firearm that includes an internal battery storage chamber having at least two inwardly stepped storage cavities that each include a plurality of battery compartments adjacently positioned longitudinally in series for storing a plurality of batteries, wherein each successive battery compartment in the series is smaller than its adjacent battery compartment when viewed from a lower portion of the firearm grip to an upper portion of the firearm grip and wherein each battery compartment shares a common wall that is substantially smooth and extends substantially across the length of the storage cavity.

In still another embodiment, the present invention is a firearm that includes a firearm grip having an internal battery storage chamber with at least one inwardly stepped storage cavity that includes a plurality of battery compartments adjacently positioned longitudinally in series for storing a plurality of batteries.

DESCRIPTION OF THE INVENTION

As illustrated in FIGS. 1–9, embodiments of the present invention are directed to a firearm grip having an internal battery storage chamber and/or a firearm grip having a hinged pull tab that removably covers a firearm grip cavity, such as a battery storage chamber.

Figure 1:
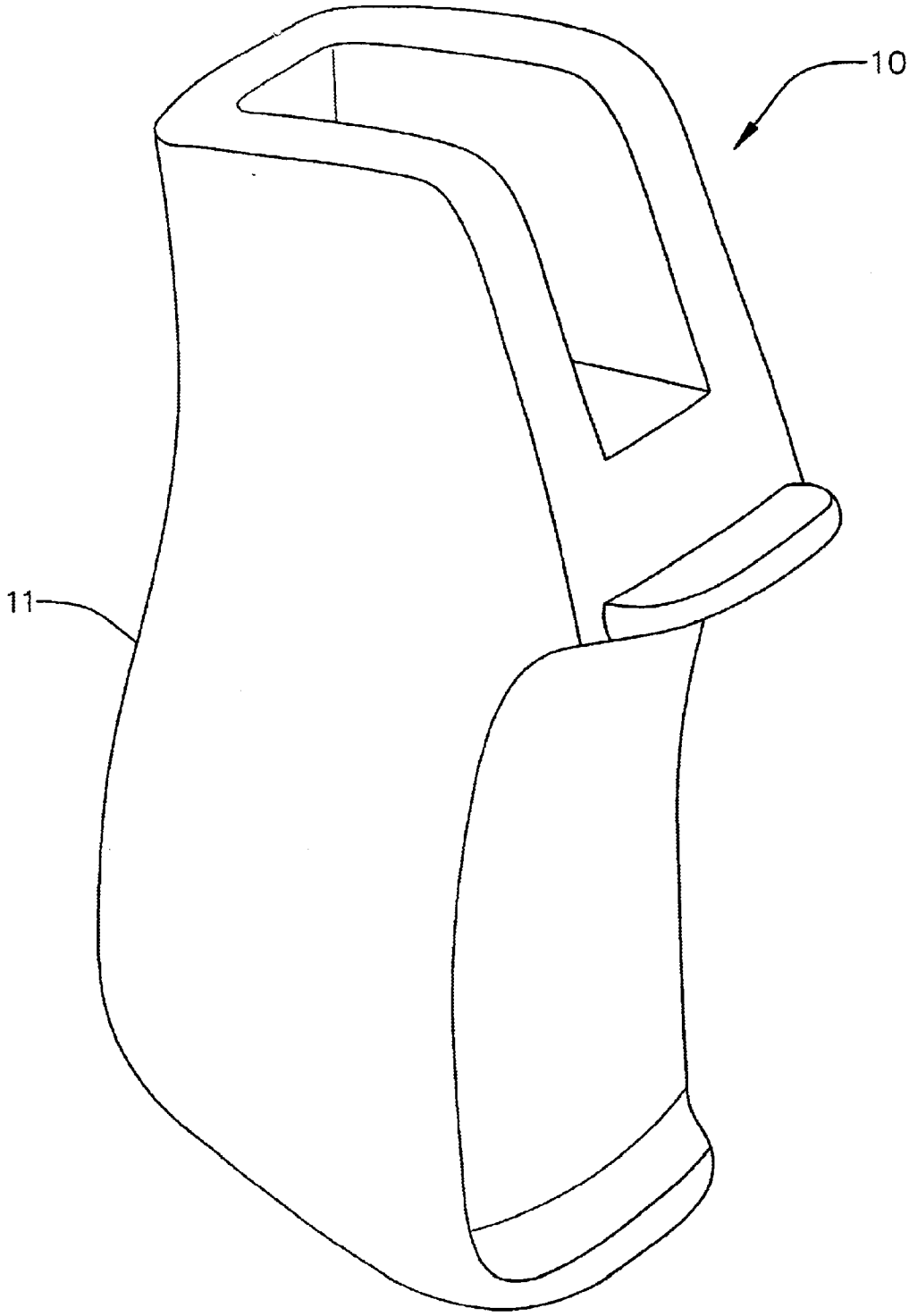
FIG. 1 is a perspective view of a firearm grip according to the present invention.
Figure 2:
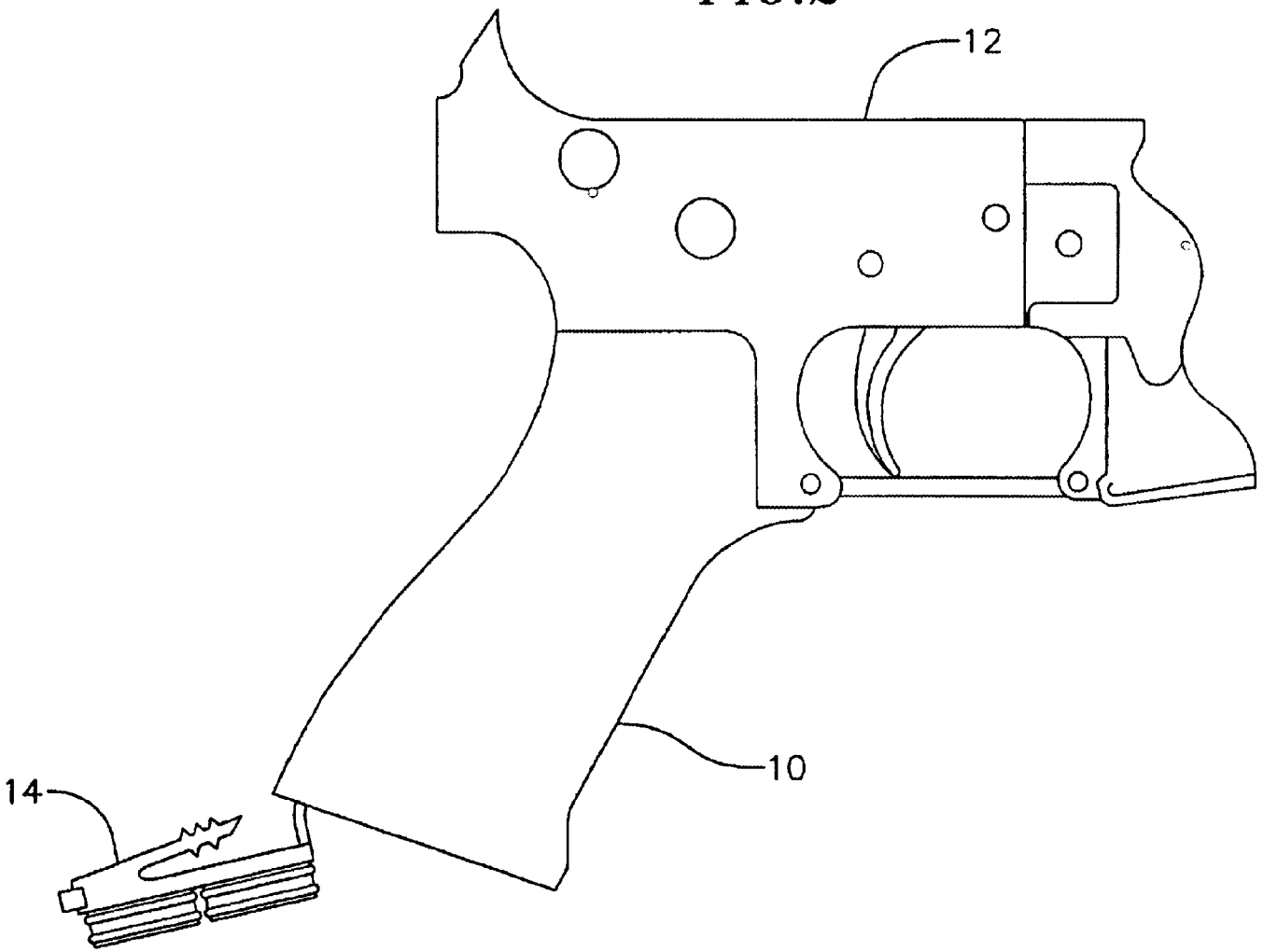
FIG. 2 is a side view of the firearm grip of FIG. 1 attached to a firearm and having, in an opened position, a hinged pull tab.

FIG. 1 shows a firearm grip 10 according to one embodiment of the present invention. FIG. 2 shows the firearm grip 10 attached to a weapon, such as a firearm or gun 12 (for clarity purposes, only a portion of the firearm 12 is shown.) As discussed in detail below, the firearm grip 10 includes a housing 11 having a pull tab 14 attached thereto, which removably covers an internal cavity of the housing 11, such as an internal battery storage chamber 16, as shown for example in FIG. 3.

Figure 3:
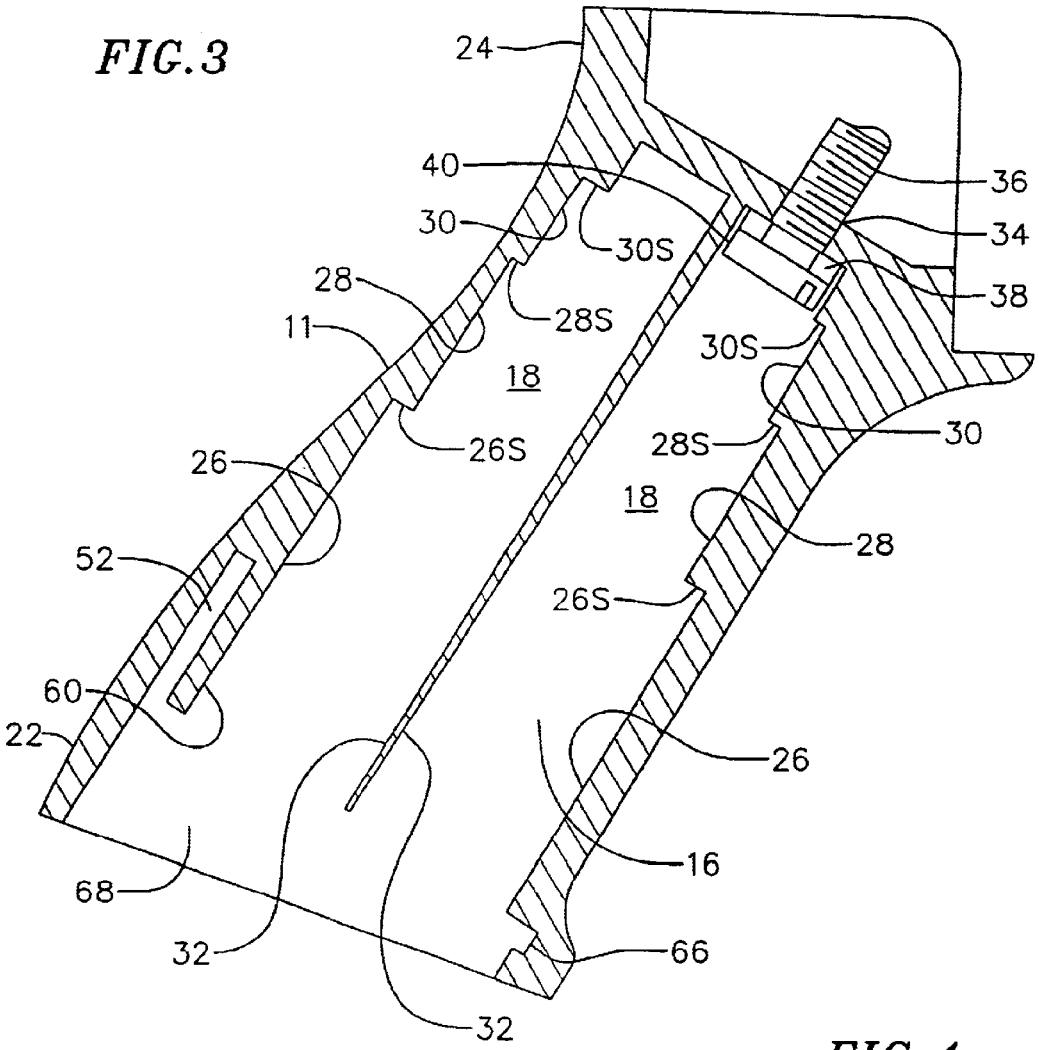
FIG. 3 is a longitudinal cross-sectional view of the firearm grip of FIG. 1 with the hinged pull tab omitted for clarity.

In the embodiment of FIG. 3, the battery storage chamber 16 includes two storage cavities 18. Each cavity 18, in turn, includes a series of inwardly stepped battery compartments that extend from a lower portion 22 of the firearm grip 10 to an upper portion 24 of the firearm grip 10.

Figure 4:
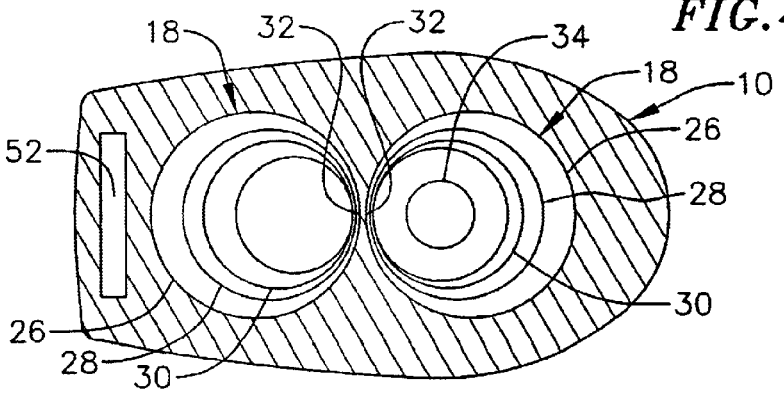
FIG. 4 is a bottom view of the firearm grip of FIG. 1 with the hinged pull tab omitted for clarity.

In the depicted embodiment, each cavity 18 includes a first battery compartment 26, a second battery compartment 28, and a third battery compartment 30. In the embodiment of FIGS. 3 and 4, each battery compartment 26, 28 and 30 is substantially cylindrical in shape, with each successive battery compartment 26, 28 and 30 having a smaller diameter than its adjacent battery compartment when viewed from the lower portion 22 of the firearm grip 10 to the upper portion 24 of the firearm grip 10.

In another embodiment, although each cavity is generally inwardly stepped from the lower portion 22 to the upper portion 24 of the firearm grip 10, one or more of the battery compartments may be substantially the same size as an adjacent battery compartment. In addition, in another embodiment, each cavity includes a plurality of battery compartments that are each of substantially the same size.

In one exemplary embodiment, each battery compartment 26, 28 and 30 also shares a common wall. For example, in the embodiment of FIGS. 3 and 4, each battery compartment 26, 28 and 30 is non-concentrically positioned with respect to the remaining battery compartments, such that a side of each battery compartment 26, 28 and 30 is aligned to form a substantially smooth common wall 32 that extends across the length of each cavity 18. The smooth wall 32 facilitates insertion of batteries into the battery compartments 26, 28 and 30 of each cavity 18.

At least one of the cavities 18 includes a fastener hole 34, for example at its uppermost end, for receiving a fastener 36, such as a screw. The fastener 36 extends through the fastener hole 34 enabling the firearm grip 10 to be removably secured to the firearm 12. A sealing washer 38 is disposed between a head 40 of the fastener 36 and the fastener hole 34 to create a fluid tight seal at the uppermost end of the corresponding cavity 18, in which the fastener hole 34 is disposed.

Opposite the common wall 32 each battery compartment 26, 28 and 30 forms a shoulder 26S, 28S and 30S at its upper end for receiving and supporting an upper end of a battery. In embodiments, where the battery compartments 26, 28, and 30 are concentric, however, each battery compartment 26, 28 and 30 forms two shoulders at its upper end for receiving a battery.

FIGS. 5A–5D show examples of how various batteries fit within the battery compartments 26, 28 and 30 according to exemplary embodiments of the invention. For example, as shown in FIGS. 5A–5D, the third battery compartment 30 is formed to securely receive a typical DL-1 type battery 42. As such, the length and diameter of the third battery compartment 30 are substantially the same as or slightly larger than the length and diameter of the DL-1 type battery 42, while the uppermost portion of the third battery compartment 30 forms the shoulder 30S that is smaller than the diameter of the DL-1 type battery 42 to prevent the DL-1 type battery from extending therepast.

Figures 5A, 5B, 5C, 5D:
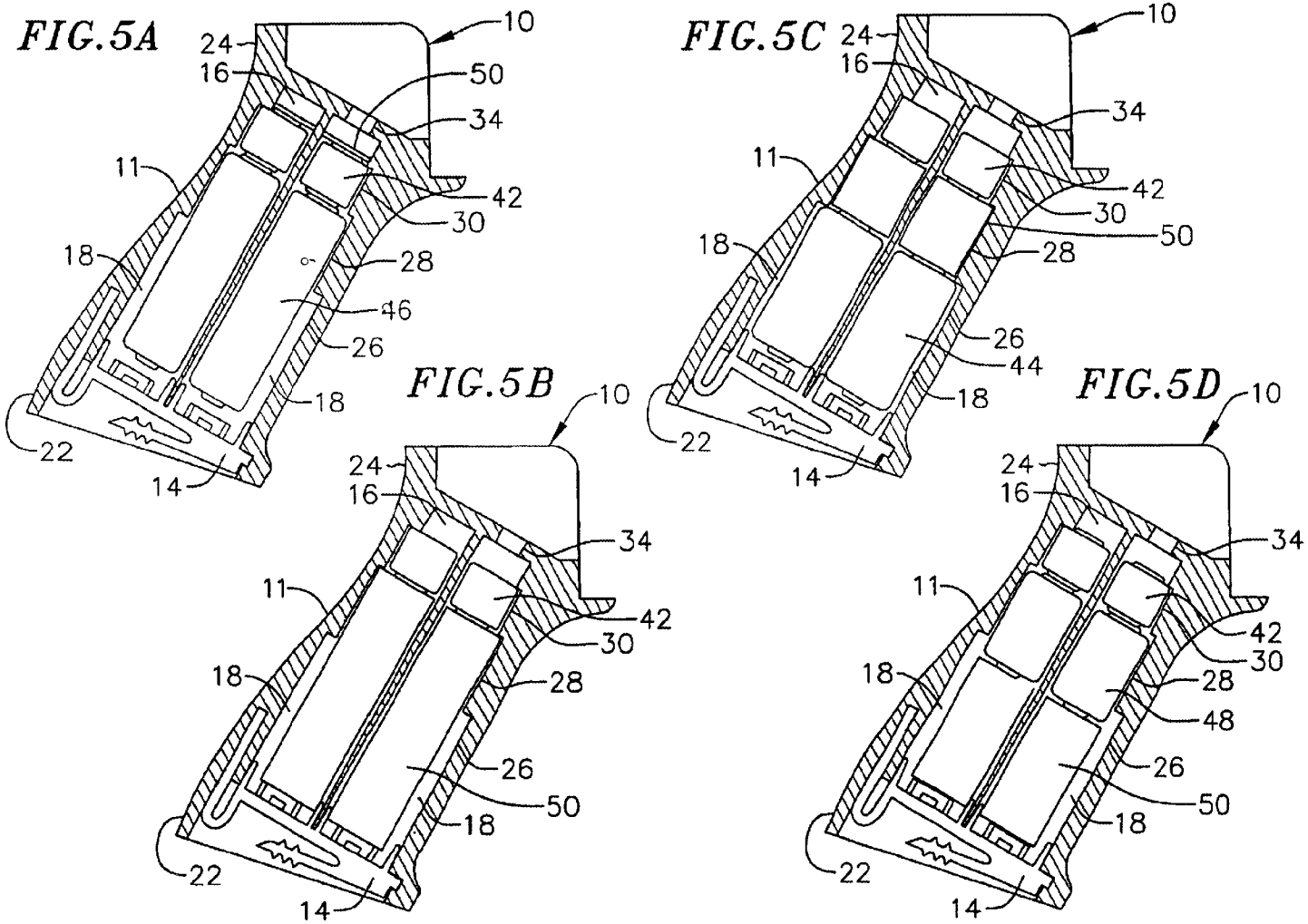
FIGS. 5A–5D each show a longitudinal cross-sectional view of the firearm grip of FIG. 1 having batteries in various battery arrangements within a battery storage chamber of the firearm grip.

As shown in FIG. 5C, the first battery compartment 26 is formed to securely receive a typical 123 Lithium Series battery 44. As such, the length and diameter of the first battery compartment 26 are substantially the same as or slightly larger than the length and diameter of the 123 Lithium Series battery 44, while the uppermost portion of the first battery compartment 26 forms the shoulder 26S that is smaller than the diameter of the 123 Lithium Series battery 44 to prevent the 123 Lithium Series battery 44 from extending therepast.

As shown in FIG. 5A, the first and second battery compartments 26 and 28 are formed to securely receive a typical AA battery 46. As such, the combined length of the first and second battery compartments 26 and 28 is substantially the same as or slightly larger than the length of the AA battery 46; and the diameter of the second battery compartment 28 is substantially the same or slightly larger than the diameter of the AA battery 46, while the uppermost portion of the second battery compartment 28 forms the shoulder 28S that is smaller than the diameter of the AA battery 46 to prevent the AA battery 46 from extending therepast.

As shown in FIG. 5D, the second battery compartment 28 is formed to securely receive a typical N type battery 48. As such, the diameter of the second battery compartment 28 is substantially the same as or slightly larger than the diameter of the N type battery 48, while the uppermost portion of the second battery compartment 28 forms the shoulder 28S that is smaller than the diameter of the N type battery 48 to prevent the N type battery 48 from extending therepast.

In any portion of each cavity 18 that does not receive a battery, a spacer 50 may be inserted to reduce movement (i.e., rattling) of the batteries within the cavity 18. In one embodiment, the spacer 50 is a foam spacer that is laterally compressible to fit within any of the battery compartments 26, 28 and 30.

In addition, the pull tab 14, discussed in more detail below, is attached to the lower portion 22 of the firearm grip 10 to support a lower surface of any battery or spacer that is positioned adjacently thereto. In one embodiment, the pull tab 14 slightly extends into the first battery compartment 26 to press against any battery or spacer that is positioned adjacently thereto. This further reduces rattling of the batteries within each cavity 18.

FIGS. 5A–5D show exemplary arrangements of batteries combinations that may be received within each cavity 18 of the firearm grip 10. For example, FIG. 5A shows each cavity 18 storing a DL-1 type battery 42 and a AA battery 46, with a spacer 50 disposed above the DL-1 type battery to reduce rattling. FIG. 5B shows each cavity 18 storing a DL-1 type battery 42 with a spacer 50 disposed therebelow to reduce rattling. FIG. 5C shows each cavity 18 storing a DL-1 type battery 42 and a 123 Lithium Series battery 44, with a spacer 50 disposed therebetween to reduce rattling. FIG. 5D shows each cavity 18 storing a DL-1 type battery 42 and a N type battery 48, with a spacer 50 disposed below the N type battery 48 to reduce rattling.

Although the battery compartments 26, 28 and 30 have been described above as capable of receiving and storing some combination of DL-1 type batteries 42, N type batteries 48, 123 Lithium series batteries 44 and AA batteries 46, the battery compartments 26, 28 and 30 may be formed to receive any appropriate type of battery and/or any appropriate combinations of batteries.

Although the battery compartments 26, 28 and 30 have been described above as being cylindrical in shape, each battery compartment 26, 28 and 30 may be formed to any one of a variety of shapes, such as rectangular, square, elliptical, or crescent, among other appropriate shapes. In addition, one or more of the battery compartments 26, 28 and 30 may have a different shape than the remaining battery compartments 26, 28 and 30 and/or each battery compartment 26, 28 and 30 may have a different shape.

Also, although each cavity 18 has been described as having three battery compartments 26, 28 and 30, each cavity 18 may have any number of battery compartments, limited only by the desired length of the firearm grip 10; and although the battery storage chamber 16 has been described as having two cavities 18, the battery storage chamber 16 may have any appropriate number of cavities 18, such as one, three or four, for example.

In one embodiment, the firearm grip 10 is formed from a non-conductive material, such as a hard plastic material, in a molding process. Although, the firearm grip 10 may be formed from any appropriate material, it is desirable that at least the lower and upper portions 22 and 24 of the firearm grip 10 and/or the upper and lower ends of each cavity 18 are either formed from a non-conductive material or insulated so that electrical current does not flow through the batteries when the batteries are stored within each cavity 18. Although the battery storage chamber 16 has been described above as being used in a firearm grip 10, the battery storage chamber 16 may be incorporated into any appropriate portable device such as a camera.

The pull tab 14 is attached to the lower portion 22 of the firearm grip 10. In one embodiment, the pull tab 14 is integrally formed from a flexible material, for example an elastomeric material, such as a rubber material. As shown in FIG. 3, the housing 11 of the firearm grip 10 includes a slot 52 for receiving the pull tab 14.

Figure 6:
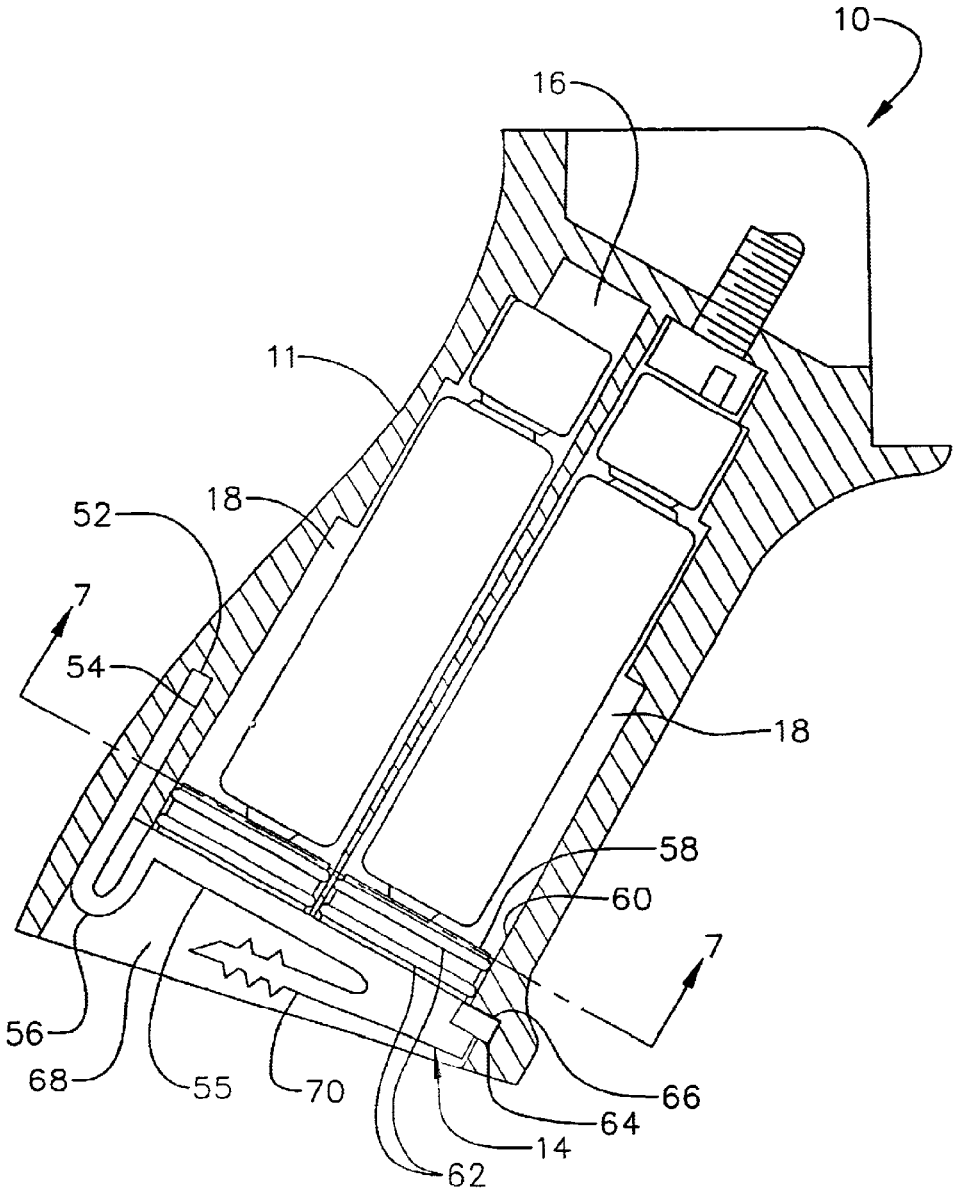
FIG. 6 is a longitudinal cross-sectional view of the firearm grip of FIG. 1 showing the hinged pull tab mounted therein for supporting batteries that are disposed within a battery storage chamber of the firearm grip.
Figure 7:
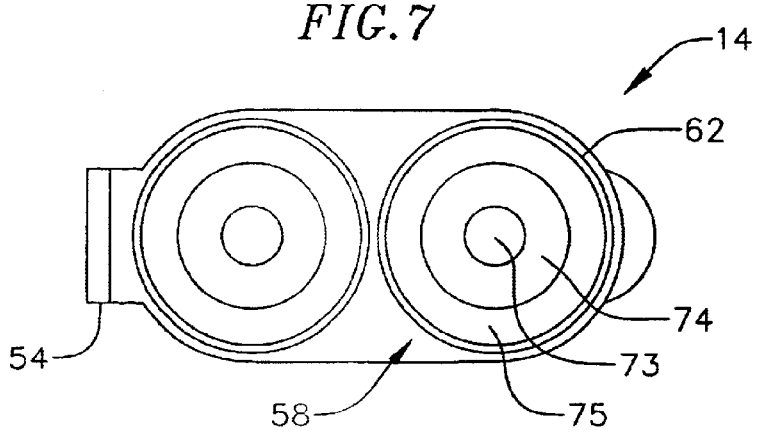
FIG. 7 is a lateral cross-sectional view of the hinged pull tab of FIG. 6 taken from line 7—7 of FIG. 6.
Figure 8:
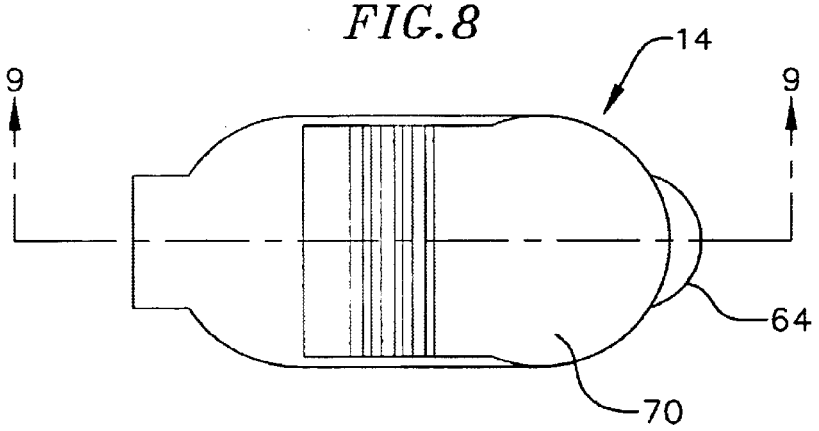
FIG. 8 is a bottom view of the hinged pull tab of FIG. 6.
Figure 9:
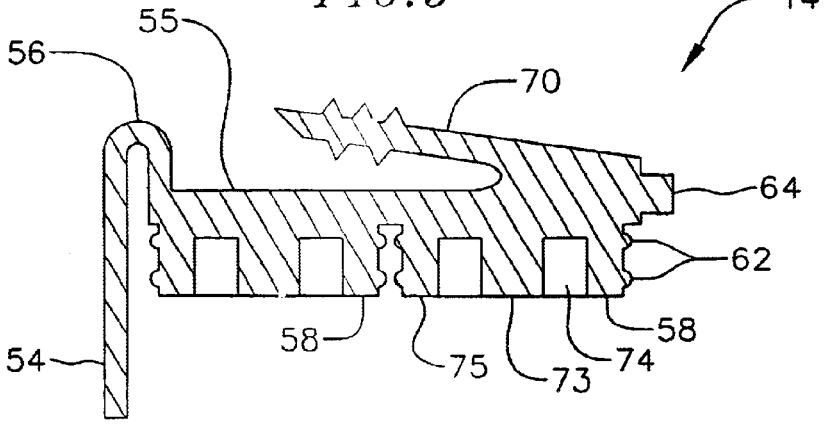
FIG. 9 is a longitudinal cross-sectional view of the hinged pull tab of FIG. 6 taken from line 9—9 of FIG. 8.

As shown in FIGS. 6 and 9, the pull tab 14 includes an arm 54 that is fixedly mounted within the slot 52, such that the pull tab 14 is integral to the firearm grip 10. The pull tab 14 may be mounted within the slot 52 by any appropriate means such as by use of an epoxy, an adhesive, a mechanical fastener, or heat fusing among other appropriate fastening means.

The arm 54 is connected to an integrally formed hinge 56 that allows for pivotal movement of the pull tab 14. The pull tab 14 has a body portion 55 that contains one or more stoppers 58. The pull tab 14 contains one stopper 58 for each cavity 18 in the battery storage compartment 16 of the firearm grip 10.

For example, in the embodiment of FIG. 6 the battery storage compartment 16 contains two cavities 18 in the battery storage compartment 16 of the firearm grip 10 and the pull tab 14 includes two stoppers 58. Each stopper 58 fits tightly within a lower opening 60 of its corresponding cavity 18 to frictionally secure each stopper 58 within its corresponding cavity 18. In one embodiment, the lower opening 60 of each cavity 18 is substantially circular and each stopper 58 is substantially cylindrical.

When secured within its corresponding cavity 18, each stopper 58 forms a water tight seal with a wall of its corresponding cavity 18 to prevent moisture from entering the cavity 18. In addition, when secured within its corresponding cavity 18, each stopper 58 longitudinally supports the batteries and/or spacers that are disposed within its corresponding cavity 18.

As shown in FIGS. 6–9, each stopper 58 has at least one circumferential ring 62, such as a circular ring. Although the depicted embodiment shows each stopper as having two circumferential rings 62, each stopper 58 may have any appropriate number of circumferential rings 62. Each circumferential ring 62 assists in frictionally securing the stopper 58 within against a wall of its corresponding cavity 18 and assists in creating a water tight seal between the stopper 58 and its corresponding cavity 18 to prevent moisture from entering the cavity 18.

In one embodiment, the pull tab 14 includes a protrusion 64 that mates with a notch 66 in the housing 11 of the firearm grip 10. In the embodiment of FIG. 3, the notch 66 is part of an opening 68 in the housing 11 of the firearm grip 10 that is disposed below the battery storage chamber 16. The mating of the protrusion 64 of the pull tab 14 with the notch 66 in the firearm grip 10 provides a locking engagement between the pull tab 14 and the firearm grip 10 and helps secure each stopper 58 within its corresponding cavity 18.

An integrally formed flexible handle 70 extends from the pull tab 14. When the handle 70 is pulled in a direction away from the lower portion 22 of the firearm grip 10, the body 55 of the pull tab 14 rotates about the hinge 56 of the pull tab 14, causing the protrusion 64 of the pull tab 14 to disengage from the notch 66 of the firearm grip 10, and causing each stopper 58 to disengage from its corresponding cavity 18. When the handle 70 is released, the handle 70 resiliently retracts adjacent to the body 55 of the pull tab 14.

Similarly, when the handle 70 is pushed in a direction towards the lower portion 22 of the firearm grip 10, the body 55 of the pull tab 14 rotates about the hinge 56 of the pull tab 14, causing the protrusion 64 of the pull tab 14 to lockingly engage the notch 66 of the firearm grip 10, and causing each stopper 58 to frictionally engage its corresponding cavity 18.

In the embodiments of FIGS. 6–9, each stopper 58 includes a an inner ring 73 and an outer ring 75 separated by a channel 74. The channel 74 assists in dust and debris collection within the battery storage chamber 16 and allows the outer ring 75 to be easily compressible. An advantage of the outer ring 75 being easily compressible is that it allows the outer ring 75 to be formed to a larger size than the lower opening 60 of its corresponding cavity 18. Thus, forming a more secure frictional engagement of each stopper 58 with its corresponding cavity 18.

In the embodiment of FIG. 6, the pull tab 14 is mounted within to the firearm grip 10 in an opening 68 in the housing 11 of the firearm grip 10 that is disposed below the battery storage chamber 16, such that when each stopper 58 is frictionally engaged with its corresponding cavity 18 and when the protrusion 64 of the pull tab 14 is lockingly engaged the notch 66 of the firearm grip 10, the pull tab 14 is disposed completely within the opening 68 with the handle 70 disposed substantially flush with a bottom surface of the firearm grip 10. Although the pull tab 14 has been described above as being used in a firearm grip 10, the pull tab 14 may be incorporated into any appropriate portable device such as a camera.

The preceding description has been presented with reference to various embodiments of the invention. Persons skilled in the art and technology to which this invention pertains will appreciate that alterations and changes in the described structures and methods of operation can be practiced without meaningfully departing from the principle, spirit and scope of this invention.

What is claimed is:

1. A grip for attachment to a firearm, the grip having a lower end and an upper end and comprising:

an internal battery storage chamber having at least one storage cavity that extends in a longitudinal direction from the lower end of the grip to the upper end of the grip to define a plurality of battery compartments for storing a plurality of batteries, wherein the at least one storage cavity comprises at least one step between adjacent battery compartments; and wherein the lower end of the grip comprises an open end that leads into the at least one storage cavity allowing batteries to be sequentially inserted into the battery compartments of the at least one storage cavity.

2. The grip of claim 1, wherein the plurality of battery compartments are continuous and adjacently positioned longitudinally in series, such that each successive battery compartment in the series is smaller, traverse to the longitudinal direction, than its adjacent battery compartment as the battery compartments ascend from the lower end of the grip to the upper end of the grip.

3. The grip of claim 1, wherein each battery compartment is substantially cylindrical in shape.

4. The grip of claim 3, wherein the plurality of battery compartments are continuous and adjacently positioned longitudinally in series, such that each successive battery compartment in the series has a smaller diameter than its adjacent battery compartment as the battery compartments ascend from the lower end of the grip to the upper end of the grip.

5. The grip of claim 1, wherein each battery compartment shares a common wall that is substantially smooth and extends substantially across the length of the storage cavity in the longitudinal direction.

6. The grip of claim 5, wherein the at least one step is disposed at a position opposed from the common wall.

7. The grip of claim 1, wherein each battery compartment is non-concentrically positioned with respect to its adjacent battery compartment, such that a side of each battery compartment is aligned to form a substantially smooth common wall that extends substantially across the length of the storage cavity in the longitudinal direction.

8. The grip of claim 1, wherein the at least one step comprises two steps.

9. The grip of claim 1, further comprising fastening means for removably attaching the grip to a firearm.

10. The grip of claim 1, further comprising a hinged pull tab fixedly attached to the lower end of the grip, wherein the hinged pull tab is pivotally moveable for removably covering the open lower end of the grip.

11. The grip of claim 1, wherein the at least one storage cavity extends substantially across the length of the grip in the longitudinal direction.

12. A firearm grip for attachment to a firearm, the firearm grip having a lower end and an upper end and comprising:

an internal battery storage chamber having at least one storage cavity that extends in a longitudinal direction from the lower end of the grip to the upper end of the grip to define a plurality of battery compartments that are adjacently positioned in series in the longitudinal direction for storing a plurality of batteries, wherein the at least one storage cavity comprises at least one step between adjacent battery compartments;

wherein each successive battery compartment in the series is smaller, transverse to the longitudinal direction, than its adjacent battery compartment as the battery compartments ascend from the lower end of the grip to the upper end of the grip;

wherein each battery compartment shares a common wall that is substantially smooth and extends substantially across the length of the storage cavity; and wherein the lower end of the grip comprises an open end that leads into the at least one storage cavity allowing batteries to be sequentially inserted into the battery compartments of the at least one storage cavity.

13. The firearm grip of claim 12, wherein each battery compartment is substantially cylindrical in shape.

14. The firearm grip of claim 12, wherein the at least one step is disposed at a position opposed from the common wall.

15. The firearm grip of claim 12, wherein each battery compartment is non-concentrically positioned with respect to its adjacent battery compartment, such that a side of each battery compartment is aligned to form the substantially smooth common wall that extends substantially across the length of the storage cavity in the longitudinal direction.

16. The firearm grip of claim 12, further comprising fastening means for removably attaching the firearm grip to a firearm.

17. The firearm grip of claim 12, further comprising a hinged pull tab fixedly attached to the lower end of the grip, wherein the hinged pull tab is pivotally moveable for removably covering the open lower end of the grip.

18. The grip of claim 12, wherein the at least one storage cavity extends substantially across the length of the grip in the longitudinal direction.

19. A firearm grip for attachment to a firearm, the firearm grip having a lower end and an upper end and comprising:

an internal battery storage chamber having at least two storage cavities that each extend in a longitudinal direction from the lower end of the grip to the upper end of the grip to define a plurality of battery compartments adjacently positioned in series in the longitudinal direction for storing a plurality of batteries, wherein the at least two storage cavities each comprise a at least one storage cavity comprises at least one step between adjacent battery compartments;

wherein each successive battery compartment in the series is smaller, transverse to the longitudinal direction, than its adjacent battery compartment as the battery compartments ascend from the lower end of the grip to the upper end of the grip; and wherein the battery compartments within each of the at least two storage cavities share a common wall that is substantially smooth and extends substantially across the length of the its corresponding storage cavity in the longitudinal direction.

20. The grip of claim 19, wherein the lower end of the grip comprises an open end that leads into each of the at least two storage cavities allowing batteries to be sequentially inserted into the battery compartments of each of the at least two storage cavities.

21. The grip of claim 19, wherein a divider between a first of the at least two cavities and a second of the at least two cavities separates the first and second cavities and comprises a first wall that forms the common wall of the first cavity and a second wall that forms the common wall of the second cavity.

22. A firearm comprising:

a firearm grip having a lower end and an upper end and comprising an internal battery storage chamber with at least one inwardly stepped storage cavity that comprises a plurality of battery compartments adjacently positioned longitudinally in series for storing a plurality of batteries; and wherein the lower end of the grip comprises an open end that leads into the at least one storage cavity allowing batteries to be sequentially inserted into the battery compartments of the at least one storage cavity.

23. A grip for attachment to a firearm, the grip having a lower end and an upper end and comprising:

an internal battery storage chamber having at least one storage cavity that extends in a longitudinal direction from the lower end of the grip to the upper end of the grip to define a plurality of battery compartments, wherein the at least one storage cavity comprises at least one step between adjacent battery compartments;

a plurality of batteries stored within the battery compartments, wherein the lower end of the grip comprises an open end that leads into the at least one storage cavity allowing the plurality of batteries to be sequentially inserted into the battery compartments of the at least one storage cavity.

24. The grip of claim 23, wherein a current does not flow through the plurality of batteries when the plurality of batteries are stored in the battery compartments.

* * * * *